US006418686B1

(12) United States Patent
Record

(10) Patent No.: US 6,418,686 B1
(45) Date of Patent: Jul. 16, 2002

(54) INSULATED ASYMMETRICAL DIRECTIONAL FORCE RESISTANT BUILDING PANEL WITH SYMMETRICAL JOINERY, INTEGRAL SHEAR RESISTANCE CONNECTOR AND THERMAL BREAK

(75) Inventor: Grant C. Record, Twin Falls, ID (US)

(73) Assignee: Leading Edge Earth Products, Inc., Seattle, WA (US)

( * ) Notice: Subject to any disclaimer, the term of this patent is extended or adjusted under 35 U.S.C. 154(b) by 0 days.

(21) Appl. No.: 09/304,221

(22) Filed: May 3, 1999

Related U.S. Application Data

(63) Continuation-in-part of application No. 08/846,002, filed on Apr. 25, 1997, now Pat. No. 5,927,032.

(51) Int. Cl.[7] ..... E04C 1/41
(52) U.S. Cl. ..... 52/309.15; 52/309.9; 52/309.12; 52/309.14; 52/284; 52/405.1; 52/412
(58) Field of Search ..... 52/309.9, 309.11, 52/390.12, 309.15, 309.17, 412, 284, 405.1, 588.1, 582.1, 587.1, 589.1, 309.1, 309.4, 309.8, 309.14, 783.1, 783.11, 783.14, 783.15, 783.19

(56) References Cited

U.S. PATENT DOCUMENTS

| | | | | | |
|---|---|---|---|---|---|
| 3,583,123 | A | * | 6/1971 | Holmgreen | 52/584 |
| 3,715,846 | A | * | 2/1973 | Sullhofer | 52/309 |
| 4,505,082 | A | * | 3/1985 | Schmitz | 52/309.8 |
| 5,440,846 | A | * | 8/1995 | Record | 52/309.15 |
| 5,673,524 | A | * | 10/1997 | Gailey | 52/309.9 |
| 5,817,990 | A | * | 10/1998 | Furse | 181/224 |
| 5,842,315 | A | * | 12/1998 | Lin | 52/309.9 |
| 5,927,032 | A | * | 7/1999 | Record | 52/309.11 |
| 6,085,485 | A | * | 7/2000 | Murdock | 52/783.19 |

* cited by examiner

*Primary Examiner*—Carl D. Friedman
*Assistant Examiner*—Yvonne M. Horton
(74) *Attorney, Agent, or Firm*—Perkins Coie LLP

(57) ABSTRACT

A structural building system including an improved, structural-load-bearing building component, such as a building panel, having front and back sections, an insulating core, integral symmetrical joinery, a thermal break, and at least one shear resistance connector. The panel is asymmetrical about one axis, and is designed to be directionally positioned with respect to the maximum anticipated force. A shear resistance connector array may be positioned between the front and back sections or may be integral to the front or back section. A face sheet may span one or more than one building panel, and provides structural support to the building system.

3 Claims, 10 Drawing Sheets

INSULATED ASYMMETRICAL DIRECTIONAL FORCE RESISTANT BUILDING PANEL WITH SYMMETRICAL JOINERY, INTEGRAL SHEAR RESISTANCE CONNECTOR AND THERMAL BREAK

CROSS-REFERENCE TO RELATED APPLICATION

This application is a continuation-in-part of U.S. patent application Ser. No. 08/846,002, filed Apr. 25, 1997, now issued as U.S. Pat. No. 5,927,032.

TECHNICAL FIELD

This invention relates to building components used for building construction and, more particularly, to premanufactured, composite building panels or other composite building components that exhibit improved strength, weight, and efficiency characteristics.

BACKGROUND OF THE INVENTION

Recent changes in today's housing industry have led to an increased use by builders of premanufactured or fabricated construction components. Premanufactured building components, such as panels, are used for walls, roofs, floors, doors, and other components of a building. Premanufactured building components are desirable because they decrease greatly the time and expense involved in constructing new building structures. However, the premanufactured building components for structural-load-bearing panels must comply with a number of required specifications based on structural criteria, such as axial load-bearing, shear and racking strengths, and total weight of the components. Additional criteria that may affect the specifications of the components include fire resistance, thermal insulation efficiency, sound abating properties, rot and insect resistance, and water resistance. In addition, the preferred premanufactured components are readily transportable, efficiently packaged, and easily handled.

Premanufactured components for building construction have in the past had a variety of constructions. A common component is a laminated or composite panel. One such composite panel includes a core material of foam or other insulating material positioned between wood members, and the combination is fixed together by nails, screws, or adhesives. These wood composite panels suffer from the disadvantage of being combustible and not mechanically stable enough for many construction applications. These wood composite panels are subject to rot, decay, and insect attack. Accordingly, wood composite panels are not deemed satisfactory for a large cross-section of modern building applications. In one variation of the wood-composite building panel, a laminated skin is fixed to the outside wood members. These panels with the laminated skin are more expensive to manufacture while suffering from the same inadequacies as the panels without the laminated skins.

A significant improvement to the building component technology was developed and set forth in my U.S. Pat. No. 5,440,846, which is hereby incorporated by reference in its entirety. The improved technology provides a structural building component, having front and back side panels positioned opposite each other, and a plurality of joining sides positioned intermediate the front and back side panels so as to substantially define a six-sided structure having an interior area therein. An insulating core is positioned in the interior area, and the insulating core has a plurality of throughholes extending between the front and back side panels. A plurality of individual shear resistance connectors are positioned in the throughholes and adhered to the front and back side panels.

Constructing the building component using the shear resistance connectors substantially increases the shear strength of the component. As a result, improved building components can be constructed to vary the load-bearing strength vs. weight characteristics of the building components by varying the thicknesses, densities and configurations of the side panels and the joining sides, and by varying the number, configuration and positioning of the shear resistance connectors. Accordingly, a person can design a building structure, determine the structural requirements for the building components, and then select a desired load-bearing strength, shear strength, and weight of the building panels to meet the structural requirements, and then construct the appropriate specified panel required for the defined application.

The improved building components with shear resistance connectors can be very strong, lightweight, and versatile building components, compared to similar panels without the shear resistance connectors. However, the manufacturing of such building components can be a relatively time-consuming and labor-intensive process, which can increase cost and lower the availability of the components.

SUMMARY OF THE INVENTION

The present invention is directed toward a structural building component that overcomes drawbacks experienced by other building components and exhibits greater structural capacity while being easier and less expensive to manufacture. In one embodiment of the present invention, the building component is an asymmetrical, directional force resisting building component forming a panel including front and back sections, an insulating core, integral joinery, and at least one shear resistance connector. The front and back sections are constructed of a first material and positioned opposite each other. The front and back sections of the building component define an interior area. An insulating core constructed of a second material different from the first material is within the interior area for improving the insulating properties without significantly adding to the weight of the building component.

The front and back sections further include integral symmetrical joinery pieces. The integral joinery allows two or more building components to be bonded together to form an integral unit, while a gap or break integral to the joinery provides a thermal break, which disallows thermal energy to pass from the inside to the outside of a building structure, or vice versa.

The building component further has an elongated channel-shaped shear resistance connector formed as part of either the front or back section. The building component is directionally oriented such that the maximum shear force can be applied to a side of the panel opposite the shear resistance connector. The front and back sections may be further adapted to receive a face sheet cladding. The face sheet may span one or several panels and provides additional synergistic structural strength advantages. A single unclad panel unit provides a first level of structural strength that exhibits advantages over the prior art such as greater structural capacities at correspondingly lower weights and smaller physical sizes, all providing greater cost effectiveness than traditional building construction materials. Two or more connected panels combine to provide a second level of structural strength that has a sum greater than the sum of the individual panels' strengths. The addition of a face sheet spanning more than one panel provides a third level of structural strength that has even greater synergistic structural strength advantages as compared to the individual panels, or the unclad connected panels.

In an alternate embodiment of the invention, the building component has a shear resistance connector array having one or more shear resistance connectors that are integrally connected to the front or back sections, and the shear resistance connectors extend at least partially into the interior area toward the other of the front or back sections. A web portion of the shear connector array is an integral portion of the front or back section, and the shear resistance connectors project away from the web portion into the interior area.

In another embodiment of the invention, the shear resistance connector array is a unitary member defining a plurality of shear resistance connectors, and a web portion is integrally connected to and spanning between the shear resistance connectors. The integrally formed shear resistance connectors are hollow with an inside area extending between a closed end of the shear resistance connector spaced apart from the web portion and open end substantially coplanar with the web portion. The web portion of the shear resistance connector array further includes one or more apertures intermediate the shear resistance connectors, and a portion of the insulating core extends through the apertures and is adjacent to the back side portion of the building component. The shear resistance connector defines an inside area that, in one embodiment, is filled with a selected material having lessor or greater density than the first material.

In another embodiment, the shear connector array is connected to the front section with the shear resistance connectors extending toward the back section and terminating at a position intermediate the front and back sections. The back section also has a shear resistance connector connected thereto that extends toward the front section. Each of these front and back sections are adapted to receive a face sheet thereon.

BRIEF DESCRIPTION OF THE DRAWINGS

In the drawings, like reference numbers identify similar elements. For ease in identifying the discussion of any particular element, the most significant digit in a reference number refers to the Figure number in which that element is first introduced (e.g., element 204 is first introduced and discussed with respect to FIG. 2).

DETAILED DESCRIPTION OF THE INVENTION

Figure 1:
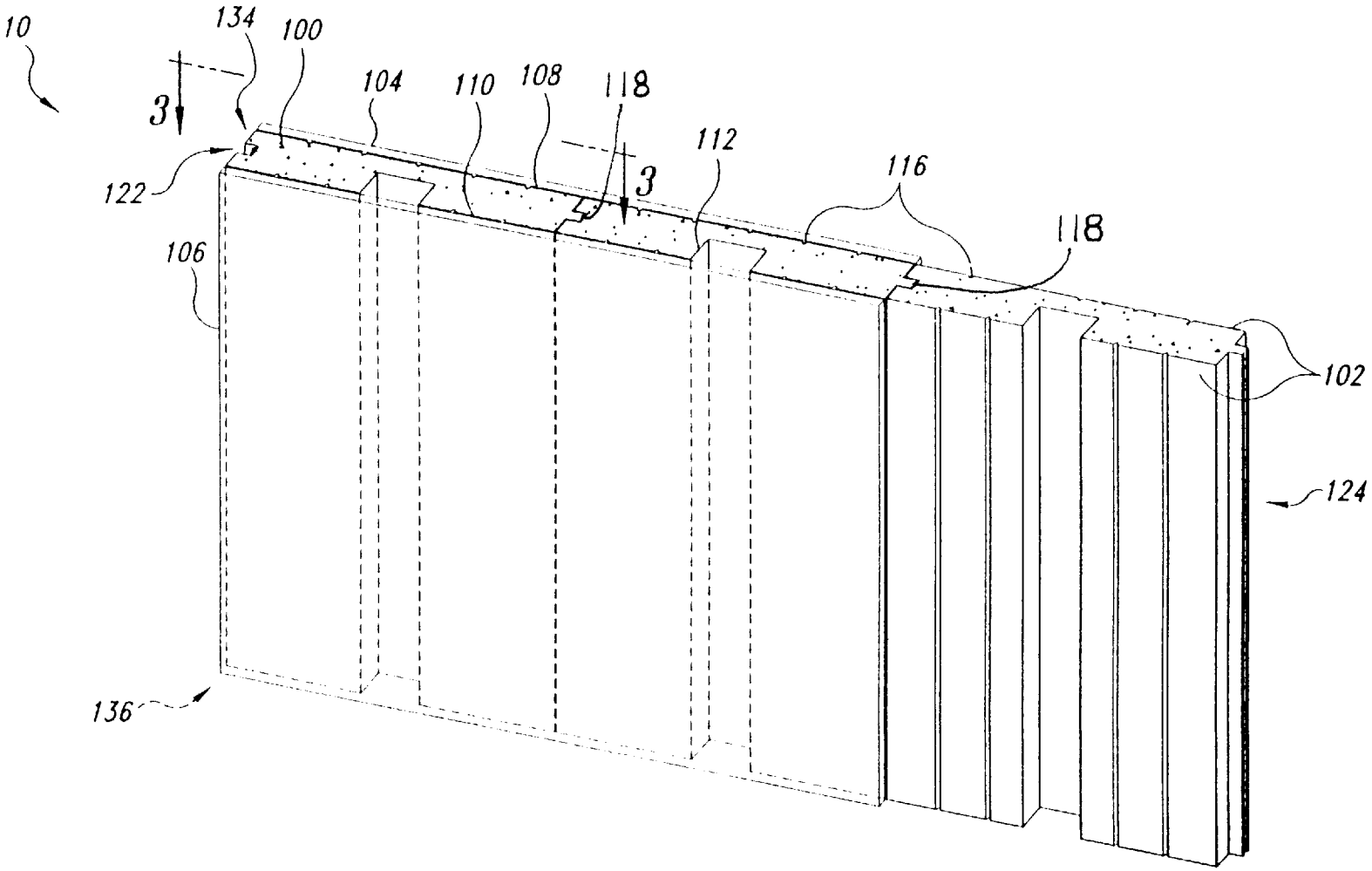
FIG. 1 is an isometric view of several assembled building component panels including a face sheet spanning two of the building components, in accordance with an embodiment of the present invention.

The present invention will be more clearly understood from the following detailed description of illustrative embodiments taken in conjunction with the attached drawings. A building panel 10 in accordance with embodiments of the present invention is shown in the drawings for illustrative purposes.

Figure 2:
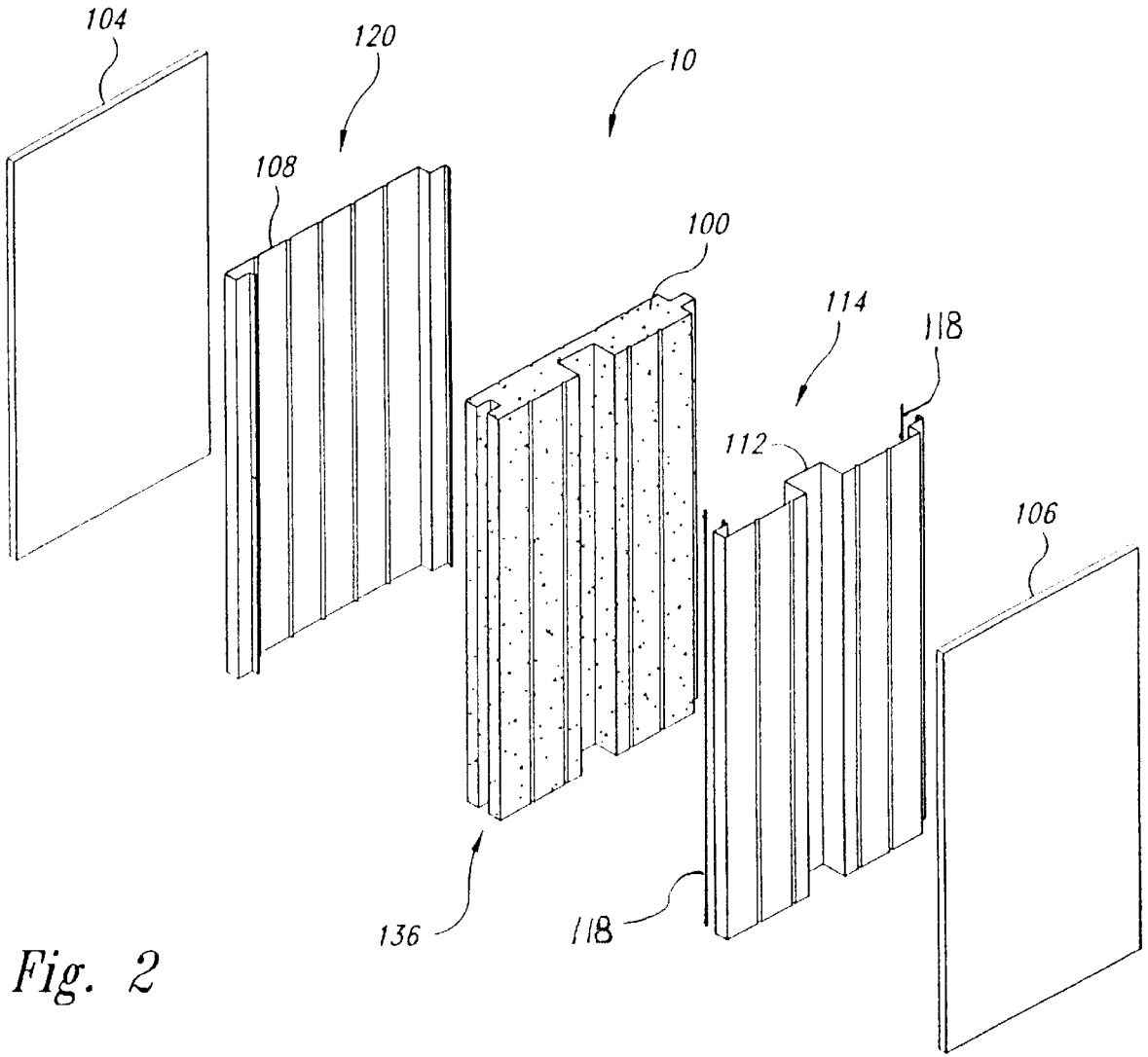
FIG. 2 is a schematic exploded isometric view of one of the building panels of FIG. 1.
Figure 3:
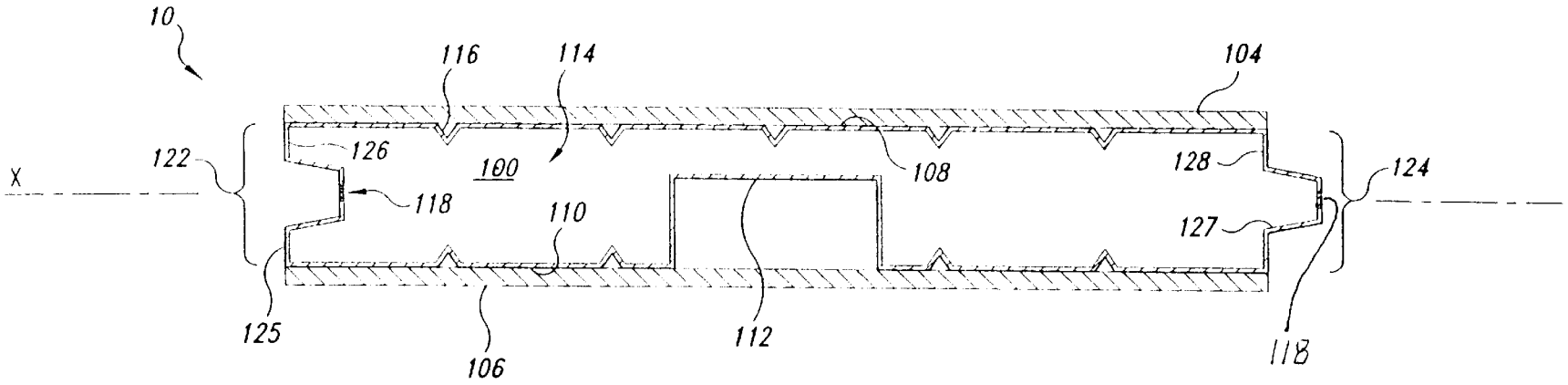
FIG. 3 is an enlarged cross-sectional view taken substantially along line 3—3 of FIG. 1.

As shown in FIGS. 1, 2 and 3, one embodiment of the present invention includes a building component 10 that is asymmetrical about the x-axis. The building component 10 has an insulative core 100 contained within an outer skin 102. The outer skin 102 of the building component includes opposing front and back sections 108 and 110 defining an interior space 114 containing the insulating core 100. The back section 110 has an elongated integral channel-shaped shear resistance connector 112 formed therein. The front and back sections 108 and 110 further define integral, symmetrical joinery portions 122 and 124 on the left and right sides of the building panel when viewed from the perspective shown in FIGS. 1, 2 and 3. The front and back sections 108 and 110 in the illustrated embodiment are each constructed of a thin metal film, such as 30 gauge roll-formed metal, contoured into the front or back section's final shape prior to assembly into the building component 10 and the two being secured together as a unit by the insulating core 100. The outer skin 102 in an alternate embodiment is constructed of plastic, ceramic, and/or cementous materials. The outer skin 102 in an alternate embodiment may be a singular section or may contain multiple sections.

When building panels 10 of the embodiment of FIGS. 1, 2 and 3 are manufactured, the front and back sections 108 and 110 are fabricated with the shear resistance connector 112, and V-shaped grooves 116 respectively, therein. A first one of the front and back sections 108 and 110 is placed in a fixture so as to provide a pan-like structure, and polyisocyanurate, polyurethane, or other expanding chemical foam is pumped into the pan-like structure in a liquid form. The chemical foam then begins to expand and the other of the front and back sections 108 and 110 is placed into the fixture on top of and secured to the first section to define the interior area 114. A spacer or blockout is used to form a thermal separator 118 between joinery components 125 and 126 forming the grooved joinery portion 122 on the left side and between joinery components 127 and 128 forming the tongue joinery portion 124 on the right side. The foam expands and completely fills the interior area 114. The foam or other insulative material forming the insulative core 100 is a self-bonding material that securely bonds itself to the front and back sections 108 and 110. The bond formed by an expanding foam with the front and back sections is an extremely strong bond, so no other adhesive is needed to integrate and hold the sections together in the form of a permanently bonded, strong, lightweight building panel 10.

The front and back sections 108 and 110 are rigidly held in position by the fixture such that the expansion of an expanding foam does not force the front and back sections 108 and 110 apart during the manufacturing process. After the foam solidifies to form the insulative core 100, the insulative core 100 and the outer skin 102 are permanently and securely bonded together by an expanding foam to form a middle portion of the building panel 10. In this embodiment, a thermal separation, between the front and back sections 108 and 110 reduces or prevents thermal heat transfer between the front and back sections 108 and 110.

The insulative core 100 of the illustrated embodiment is a solid member constructed of cured expanded foam that has a thermal insulative value in the range of 3R to 9R per inch. In alternative embodiments, the insulative core 100 is constructed of modified polyurethane foam, other expanding chemical foam material, or other insulative material having a thermal insulative value within the range of 1R to 9R per inch. The range of thermal insulative values of the insulating core 100 is a preferred range, although the insulating core can have a thermal insulating value that deviates from the preferred range without departing from the spirit and scope of invention.

The building component 10 is asymmetrical about the x-axis wherein the front and back sections 108 and 110 have different cross-sections. The back section 110 has an elongated, integral, channel-shaped shear resistance connector 112 formed therein. The shear resistance connector 112 defines a substantially rectangular channel that extends between the top and bottom ends 134 and 136 of the building component 10. The shear resistance connector 112 provides increased shear resistance and enhances the structural strength of the building component. Thus, the side of the building panel 10 that has the shear resistance connector 112 has the ability to resist greater shear forces than a side of a panel without a shear resistance connector. The front section 108 of the illustrated embodiment has V-shaped grooves 116 that are individual elongated shear resistance connectors that prevent localized buckling of the panel. Accordingly, the building component 10 is directionally oriented such that a maximum shear force can be resisted when a transverse load is applied to the front section 108 of the building component 10 opposite the back section 110 containing the shear resistance connector 112.

The substantially rectangular shear resistance connector 112 extends away from the back section 110 toward the front section 108 and terminates at a position within the interior area 114 between the front and back sections 108 and 110. In the illustrated embodiment, the overall panel width is approximately two feet wide, and four inches thick. The shear resistance connector 112 extends approximately 62.5% of the way across the interior area, and the shear resistance connector does not contact or engage the front section 108. The width of the substantially rectangular shear resistance connector on the illustrated embodiment is approximately 4" or approximately 16.67% of the panel's total width. The shear resistance connector in the illustrative embodiment is equidistant from the ends of the panel.

In alternate embodiments, the shear connector 112 extends across the interior area 114 within the range of approximately 35% to 100%, inclusive, of the distance between the front and back sections 108 and 110. The width of the shear resistance connector 112 in alternate embodiments may vary within the range of approximately one-twelfth to one-third of the overall panel width. The shear resistance connector 112 is securely and rigidly bonded to the insulative core 100, such that the connection along the surface of the shear resistance connector 112 adds a significant amount of strength to the building panel 10 without a significant weight increase.

The overall panel dimensions as well as the dimensions and positioning of the shear resistance connector 112 may be varied depending on the intended end use of the panel. Reducing the overall panel dimensions, for example, may increase the strength capacity of the panel unit 10, while decreasing the amount of insulation and the overall weight. Conversely, for example, increasing the overall panel dimensions may reduce the strength capacity of the panel unit 10 and reduce the cost to manufacture and install the panel 10.

The front section 108 is substantially flat and has a plurality of V-shaped grooves vertically aligned and integrally formed therein. The V-shaped grooves 116 add shear structural support to the building component, for example, to prevent localized buckling. The asymmetry of the panel, wherein the back section 110 has a shear resistance connector 112 and the front section 108 is substantially flat, allows the panel 10 to be oriented relative to the maximum anticipated load. The shear resistance connector 112 provides maximum shear force resistance when it is oriented away from the transverse or acting load. The building components 10 are interchangeable for use as bearing wall panels, partition walls, floors, ceilings, or roofs. Therefore, when the building component 10 is used as a floor or ceiling panel, for example, the front section 108 faces upwardly and the back section 110 with the shear resistance connector 112 facing downward. When the building component 10 is used as an exterior wall panel, the front section 108 faces outwardly toward the side of the structure exposed to the outside environment.

As best seen in FIG. 3, the front and back sections 108 and 110 have shaped edge portions 125, 126, 127, and 128 that connect to each other to form left and right integral joinery portions 122 and 124 on the left and right sides of the building component 10. The shaped edge portions 125 and 126 on the left, as well as 127 and 128 on the right, are mirror image shapes of one another such that the completed joinery portion 122 and 124 are symmetrical about the x-axis. The symmetrical joinery portions 122 and 124 are tongue and groove components wherein, in the illustrative embodiment, the right side defines the tongue and the left side defines the groove. Accordingly, each joinery portion is adapted to mate with a joinery portion of adjacent building panels when two adjacent building components 10 are interconnected. The tongue joinery portion 124 is shaped and sized to be positioned in a corresponding groove joinery portion 122 of an adjacent panel. The connection is made between panels with an adhesive bonding material.

In the illustrated embodiment, adjacent edge portions of the front and back sections 108 and 110 are spaced apart from each other by a gap, and the thermal separator 118 is positioned in the gap. Accordingly, each of the left and right joinery portions 122 and 124 include a thermal break that separates the front and back sections. The thermal break reduces the transfer of heat between front and back sections of the building component 10, thereby increasing the panel's effective insulation value.

The illustrated panel is a non-combustible panel with a high insulative factor as discussed above. The panel 10 constructed as illustrated further provides a panel that is substantially rot and insect resistant as well as substantially water impermeable. Additionally, when placed under a load, the panel bends as opposed to breaking, and substantially recovers from large transverse deflections after removal of the loads. This ability of the structural component to bend and recover from load deflections allows the component to be effective in resisting and recovering from seismic and wind loads.

In the illustrated embodiment of FIGS. 1, 2 and 3, top and bottom ends 134 and 136 of the building component 10 are open such that the insulative core 100 is exposed prior to installation of the building component 10. In an embodiment wherein the building panel 10 is for use as a wall panel, the top and bottom portions 134 and 136 are adapted to fit within conventional top and bottom channels, respectively, for example, that are attached to a floor or ceiling of a building structure. Accordingly, the channels cap the top and bottom portions 134 and 136 of building components.

In an alternate embodiment, end caps (not shown), made from 16 gauge steel bent into a channel shape with approximately 2" flanges and a web depth approximately 1/16" larger than the nominal panel thickness, are secured (e.g., bonded and screwed) onto the top and bottom portions 134 and 136 of the panel 10. These end caps serve to protect the ends of the sheet metal faces from local damages and provide an integral mechanism by which the panels 10 are connected to foundations, roofs, or intermediate floors.

In another alternate embodiment, not illustrated, the top and bottom portions 134 and 136 are fully closed with caps integral to the front and back sections 108 and 110, such that the insulative core 100 is not exposed. In yet another alternate embodiment, the front and back sections 108 and 110 are formed such that the joinery portions 122 and 124 are provided along the sides and joinery portions are also provided along the top and bottom ends 134 and 136 of the building panel 10. Accordingly, as the building panels 10 are connected together during construction, for example, of a multi-story building structure, the joinery portions along the top, bottom, left and right sides of each building panel form a junction between adjacent building panels. Adjacent building panels 10 are secured together, as an example, with an adhesive bonding material and/or conventional fasteners.

The assembled structural panel 10 is an extremely resilient, load bearing structural component having a high strength-to-weight ratio. In one embodiment in which the structural panel 10 is a two foot wide wall panel or a two foot wide floor panel with a floor covering panel included, the strength-to-weight ratio of the structural panel 10 is at least 33 to 1. This means that one pound of panel 10 is capable of supporting 33 pounds of load. The panel 10 meets this minimum strength-to-weight ratio regardless of whether the loading is transverse or axial. In another embodiment, testing demonstrates that the panel 10 has a strength-to-weight ratio of approximately 44 to 1 for transverse load, and approximately 127 to 1 for an axial load.

Combining the panels 10 together creates a second level of synergistic strength. The first level of strength is the building panel 10 itself. The building panel 10 exhibits greater structural-load-bearing capacity than non-load bearing panels that are on the market. Connecting two or more panels provides a second level of strength that is greater than simply the sum of the panel's individual strengths. This synergistic composite strength results in a stronger building system when the panels 10 are combined to form the wall, roof, floor or ceiling system. A third synergistic strength relationship is created when a face sheet is laminated to the surface of a single panel. Yet a fourth level of strength is created when a face sheet is laminated to the surface of two or more panels 10 and across the joint between the adjacent panels.

In an alternate embodiment, only one of the front or back face sheets 104 and 106 is adhered to the outer skin 102 before the building panel 10 is shipped to a construction site. The building panels 10 with the single face sheet are joined together at the construction site, and the other of the front or back face sheets 104 and 106, is then added to the building panel. The face sheet added at the construction site in accordance with the specification of the construction project can be added to the building panels in an efficient and timely manner, thereby resulting in a completed building that utilizes the beneficial characteristics of the building panel 10.

In the illustrative embodiment of FIG. 1, the building panel 10 is clad in face sheets 104 and 106. The front and back face sheets 104 and 106 may be adhered to the front and back sections 108 and 110 of the outer skin 102. In the embodiment illustrated in FIG. 1, the front and back face sheets 104 and 106 are adhered to the outer skin 102 by an adhesive layer. The bond provided between the outer skin 102 and the face sheet has a sufficient strength to ensure the strength requirements of the panel 10 are met. In another embodiment, the front and back face sheets 104 and 106 are adhered to the outer skin with an adhesive layer.

The face sheets 104 and 106 shown in FIG. 1 span across at least two building panels 10, thus tying the individual building panels together to create a synergistic strength relationship. This relationship results in a composite system that has a greater overall strength than the individual strengths of the system's components. In alternative embodiments, the face sheet spans one or more of the individual building panels 10. Further, the joint of adjacent face sheets may be staggered with respect to the joint between the building panels 10. The face sheet in alternate embodiments is constructed of plastic, metal, ceramic and/or cementious materials.

Figure 4:
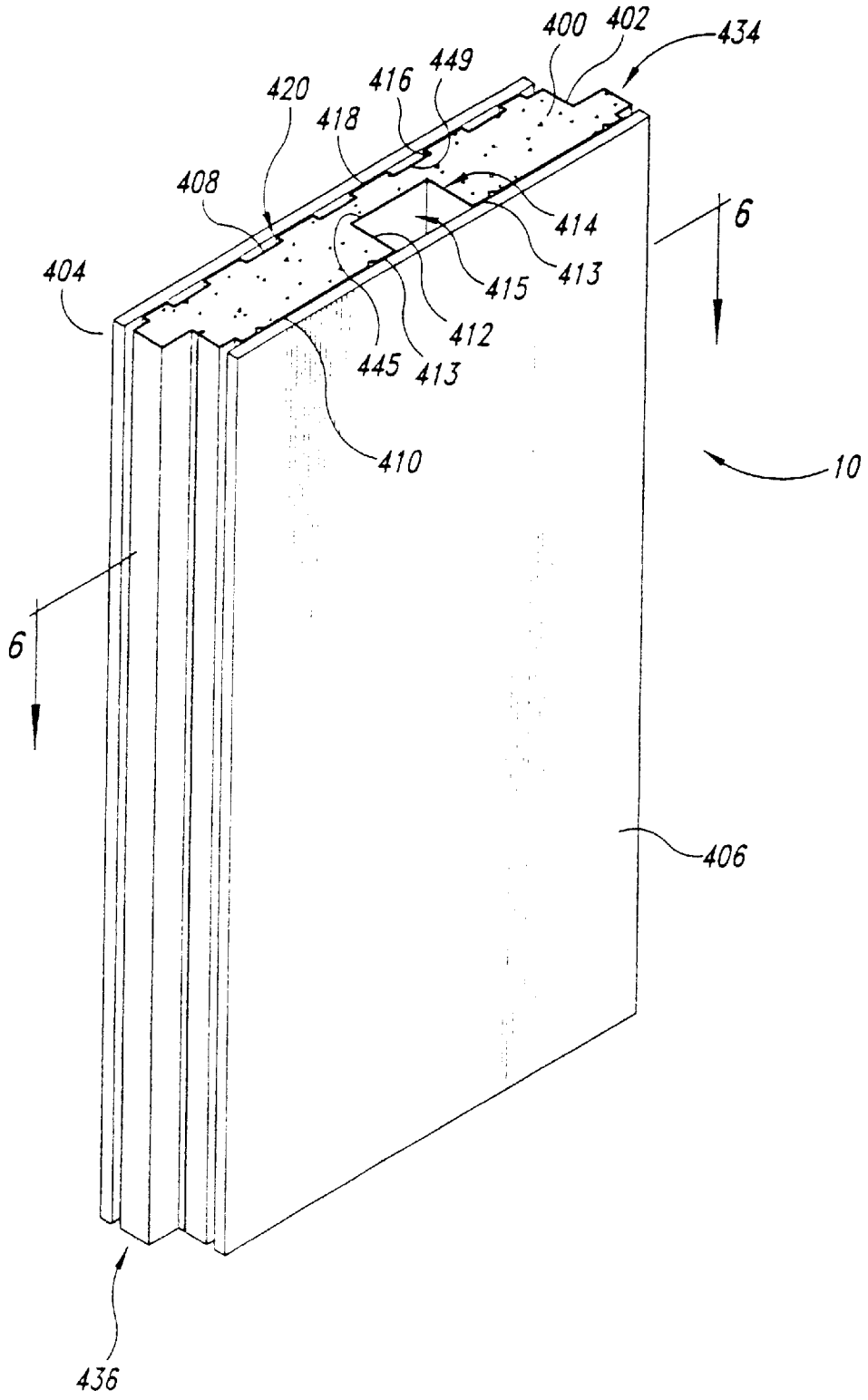
FIG. 4 is an isometric view of a building panel in accordance with an alternate embodiment of the present invention.
Figure 5:
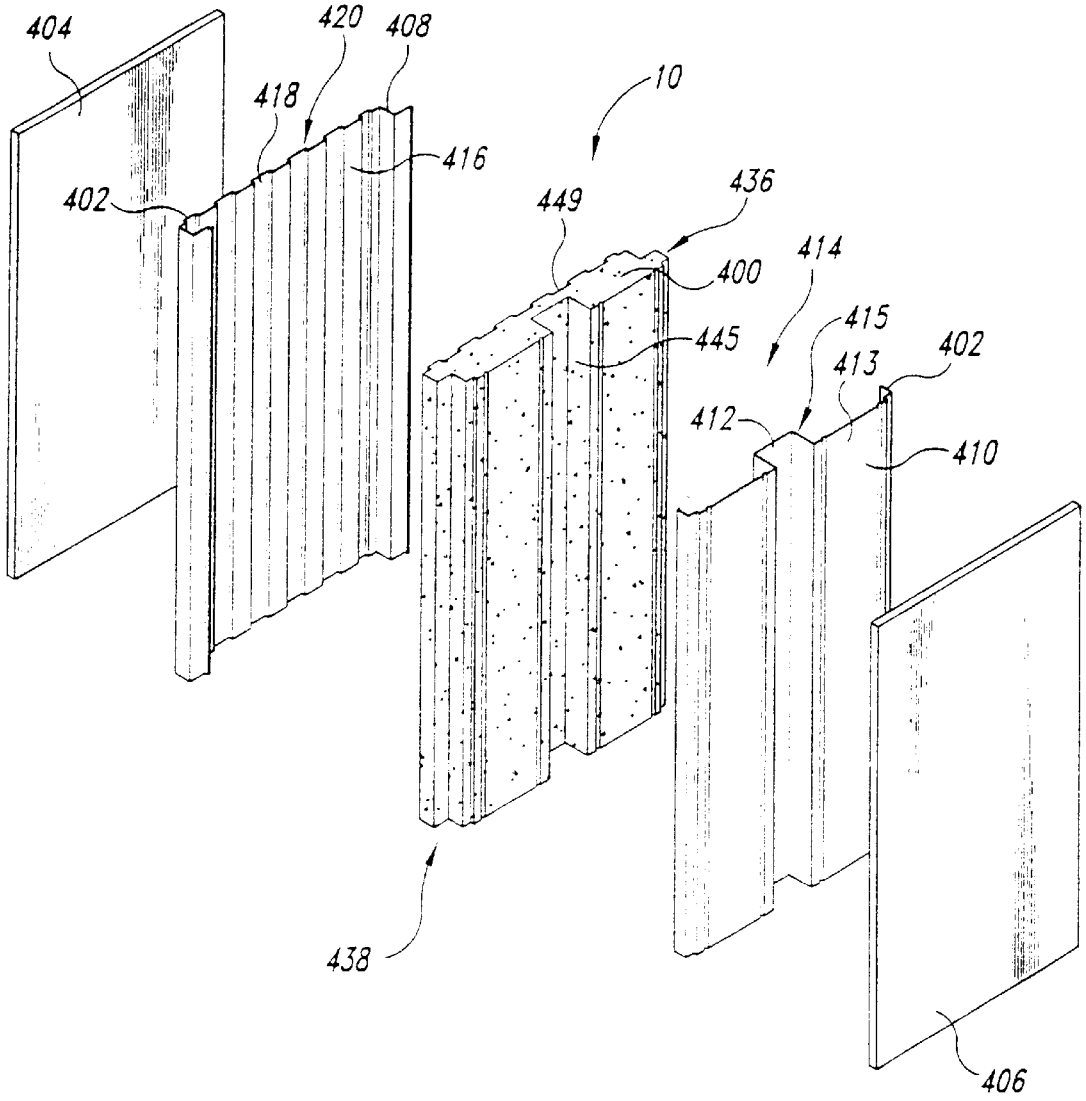
FIG. 5 is a schematic exploded isometric view of the building panel of FIG. 4.
Figure 6:
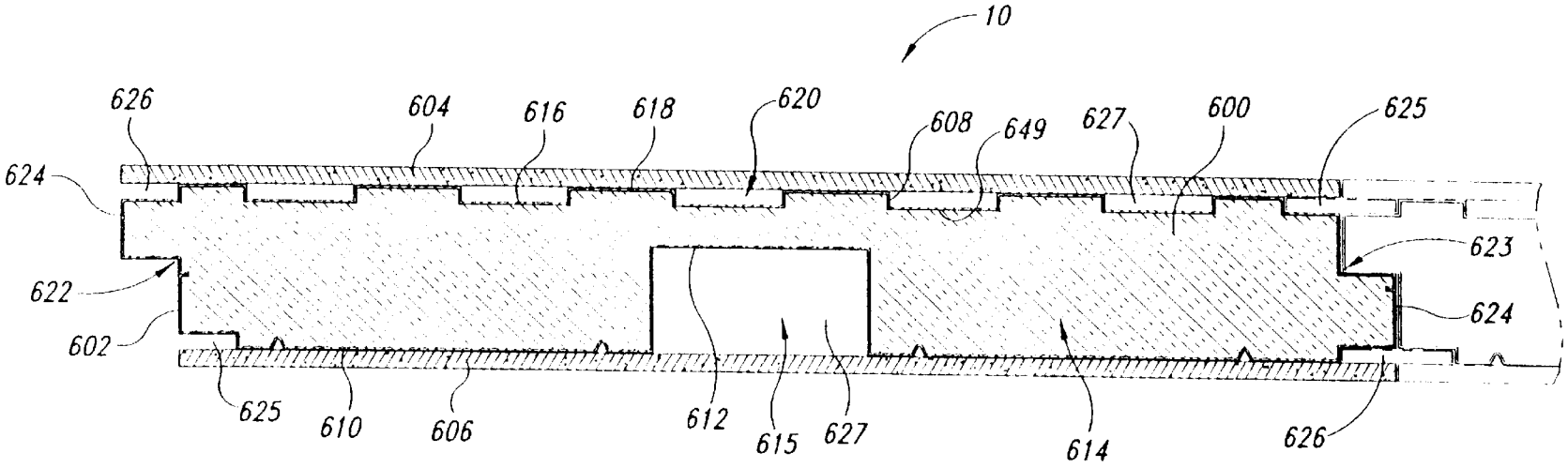
FIG. 6 is an enlarged cross-sectional view taken substantially along line 6—6 of FIG. 4 showing an adjacent panel in phantom lines.

As best seen in FIGS. 4–6, an alternate embodiment of the present invention includes a building panel 10 having the insulative core 400 contained within an outer skin 402. Front and back face sheets 404 and 406 are connected to opposing sides of the outer skin 402 to form the front and back sides of the building panel 10. The outer skin 402 is formed by front and back sections 408 and 410 that are connected together to define an interior area 414, which is filled by the insulative core 400.

As illustrated by this embodiment, the outer skin's front section 408 has a plurality of elongated shear resistance connectors 416 integrally formed therein that extend between the top and bottom edges 434 and 436 of the building panel 10. Each of the shear resistance connectors 416 is spaced-apart from adjacent shear resistance connectors by a portion of the front section that define a web portion 418. Accordingly, the shear resistance connectors 416 and the web portions 418 are integrally formed in the outer skin's front section 408 and are integrally connected together to define a shear resistance connector array 420.

The shear resistance connectors 416 extend away from the web portions 418 into the interior area 414 and terminate at a position spaced apart from the outer skin's back section 410. Each of the shear resistance connectors 416 extend into apertures 449 that extend partially through the insulative core 400. The distance the shear resistance connectors 416 and apertures 449 extend into the interior area 414 is in the range of approximately 10%–30%, inclusive, of the distance between the front and back sections 408 and 410. The shear resistance connectors 416 engages and are securely and rigidly bonded to the portions of the insulative core 400 defining the apertures 449 so as to increase the strength of the building panel without a significant weight increase.

The size and configuration of the shear resistance connectors 416 of the outer skin's front section 408, and the size and configuration of the shear resistance connector 412 of the outer skin's back section 410 are different for building panels 10 having different structural requirements. The sizes and configurations of the shear resistance connectors 412 and 416 are selected during the design of a building panel 10 to provide the desired compressive strength, shear strength, tensile strength, flexural strength, weight, insulative value, and acoustical characteristics selected for the particular building panel.

In alternate embodiments, the shear resistance connector array 420 of the back section 410 has the shear resistance connector 412 with different shapes, such as an arcuate shape or a V-shape channel. In another embodiment, the shear resistance connectors 416 of the outer skin's front section 408 are defined by a plurality of cylindrical-shaped shear resistance connectors, that are spaced apart from each other and integrally connected to the web portion 420.

As best seen in FIG. 6, the front and back sections 608 and 610 are formed with integral joinery portions 622 and 623 on left and right sides of the building panel 10 that are adapted to mate with joinery portions 622 and 623 of adjacent building panels when building panels are interconnected in a side-by-side relationship. The left and right joinery portions 622 and 623 have a step configuration with a tongue portion 624 extending outwardly away from the interior area 614. The tongue portion 624 is shaped and sized to be positioned adjacent to the tongue portion of an adjacent building panel, shown in phantom lines in FIG. 6. The tongue portion 624 of each joinery portion 622 and 623 has a first recess 625 formed therein and a similar second recess 626 is formed adjacent to the joinery portions 622 and 623 opposite the first recess. When the joinery portions 622 and 623 of the two building panels 10 are joined together in a side-by-side relationship, the recesses 625 and 626 are adjacent to each other and receive a spline therein (shown in phantom lines) that is used to interconnect the building panels. Although the joinery portions 622 and 623 illustrated in FIG. 6 have a single tongue configuration, other joinery configurations are used in alternate embodiments.

The front and back face sheets 604 and 606 are adhered to the respective front and back sections 608 and 610 of the outer skin 602. In the embodiment illustrated in FIG. 6, the front and back face sheets 604 and 606 are connected directly to the outer skin with an inside area 627 defined by the shear resistance connectors 612 and 616 are closed and unfilled.

Figure 7:
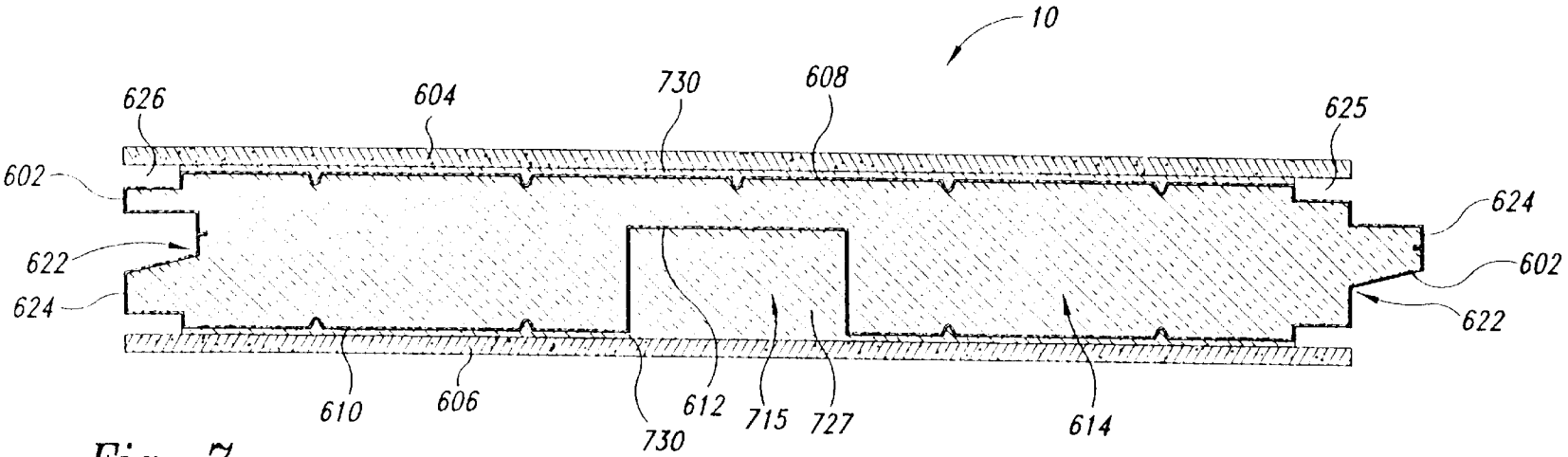
FIG. 7 is a cross-sectional view similar to FIG. 6 with shear resistance connectors being filled with a selected material.

In an alternate embodiment of the invention shown in FIG. 7, the building panel 10 has the shear resistance connector array 715 with the single channel-shaped shear resistance connector 612, and the outer skin's front section 608 does not include a shear resistance connector array. The building panel 10 has an adhesive layer 730 positioned between the front section 608 and the front face sheet 604 and between the back section 610 and the back face sheet 606. In the illustrated embodiment, the adhesive layer 730 is formed of the same foam material as the insulative core 600, such as the polyisocyanurate or other closed-cell urethane foam. The adhesive layers 730 extend into the inside area 727 in the shear resistance connector 612 and fully fill the shear resistance connectors. Accordingly, the shear connector array 715 is fully encased and rigidly connected to material on all sides, which results in a building panel 10 having an increased strength without a substantial weight increase.

In selected embodiments, each building panel 10 is approximately two feet wide, eight feet tall, and four inches thick. In an alternate embodiment, the panel can have a width of four feet or more. These dimensions are provided for illustrative purposes, and a building panel 10 in accordance with the present invention can have different dimensions and ranges of dimensions without departing from the spirit and scope of the invention.

Figure 8:
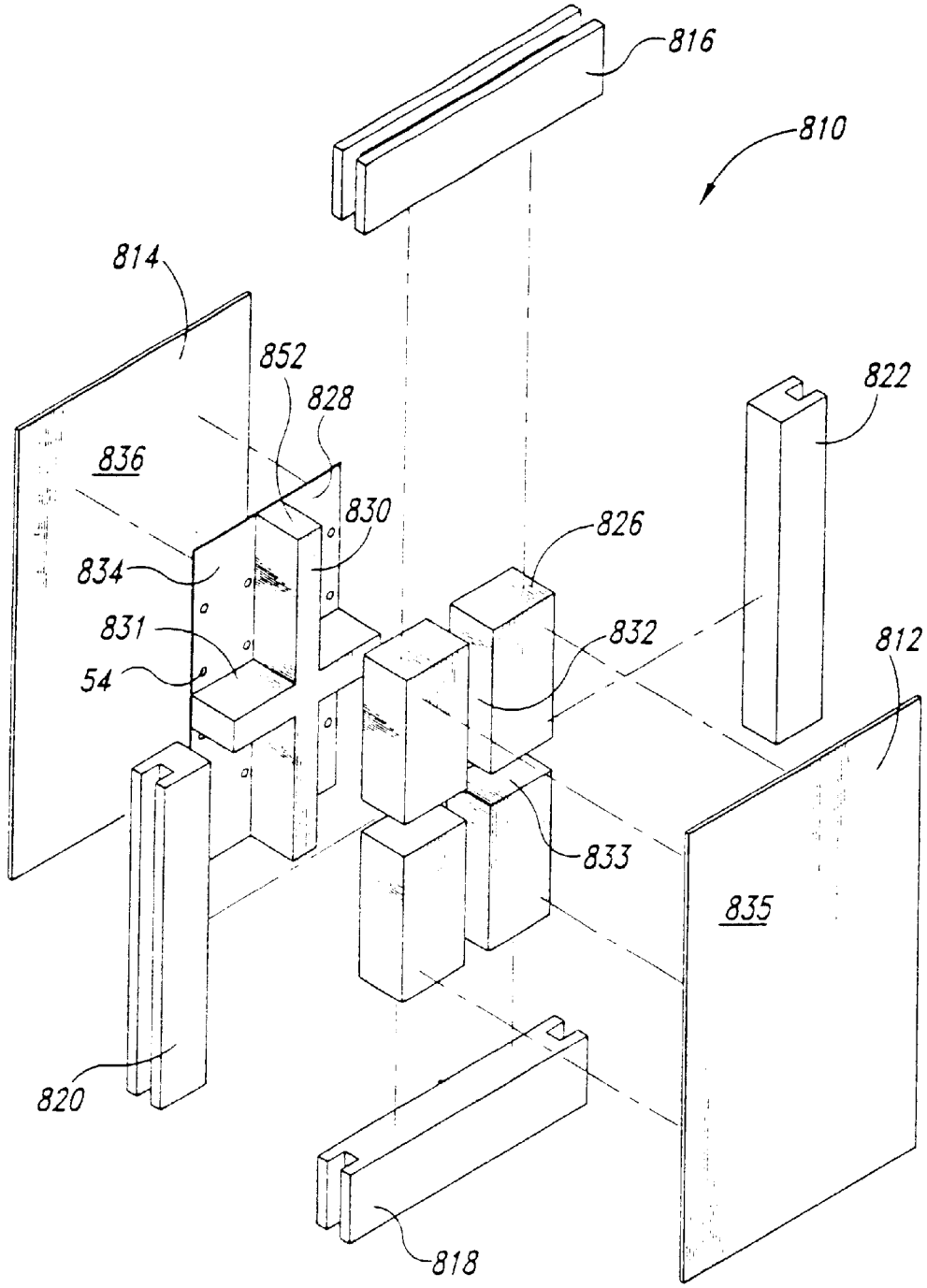
FIG. 8 is a schematic exploded view of an alternate embodiment of the building panel in accordance with the present invention.

As best seen in FIG. 8, another alternate embodiment of the present invention includes a shear resistance connector array 828 having a web 834 attached to a first elongated shear resistance connector 830 that extends between the top and bottom joining sides 816 and 818. The web 834 is also attached to a second elongated shear resistance connector 831 that extends between the left and right joining sides 820 and 822 transverse to the first elongated shear resistance connector 830 such that the first and second shear resistance connectors define a substantially cross-shaped pair of shear resistance connectors. Each of the first and second elongated shear resistance connectors is formed by a channel having a depth that substantially corresponds to the depth of the insulating core 826.

The insulating core 826 of this alternate embodiment has elongated throughholes 832 and 833 that receive the first and second shear resistance connectors 830 and 831, respectively. Accordingly, the first shear resistance connector 830 forms a post-like structure extending along its respective throughhole 832 within the panel 810 and the second shear resistance connector 831 forms a beam-like structure extending along its respective throughhole 833.

In another alternate embodiment, the throughholes 832 and 833 extend diagonally through the insulating core 826 and the first and second shear resistance connectors 830 and 831 extend diagonally through the interior chamber 824 of the panel 810. Accordingly, the first and second shear resistance connectors 830 and 831 form an X-shaped pair of shear resistance connectors within the panel. In other alternate embodiments not shown, the shear resistance connector array 828 has a single elongated shear resistance connector extending through the interior chamber vertically, horizontally, or diagonally between the top and bottom joining sides 816 and 818 on the left and right joining sides 820 and 822, and the insulating core 826 has a corresponding throughhole that receives the shear resistance connectors.

In one method of making the building panel 810, the back face sheet 814 and the joining sides 816, 818, 820, and 822 are fixedly adhered together. The web 834 of the shear resistance connector array 828 is adhered to the interior surface 836 of the back face sheet 814, such that the shear resistance connectors 830 extend across the interior chamber 824 of the building panel. Thereafter, the front face sheet 812 is adhered to the joining sides 816, 818, 820, and 822 and also adhered to the closed free ends 852 of the shear resistance connectors 830. Then, a predetermined amount of the polyisocyanurate foam or other modified polyurethane foam is injected into the interior chamber 824 through at least one injection hole. After a predetermined amount of foam is added, the injection hole is then plugged to prevent the foam from expanding and flowing out of the interior chamber 824.

These manufacturing processes of pumping the expanding liquid foam into the interior chamber 824 can result in substantial pressure being exerted on the front and back face sheets 812 and 814 and the joining sides 816, 818, 820, and 822 as the foam attempts to fully expand. After the foam has solidified, however, the pressure from the foam expansion ceases. Accordingly, if an insulating core 826 having a higher density is desired, a greater amount of foam is pumped into the interior chamber 824, and the front and back face sheets 812 and 814 and the joining sides 816, 818, 820, and 822 are structurally supported by a jig or the like that protects the panel from expanding and separating. Accordingly, the density, weight, insulative value, and compressive strength of the insulating core 826 and thus, the building panel 810, is easily controlled by increasing or decreasing the amount and type of foam pumped into the interior chamber 824.

In addition to controlling the properties of the building panel 810 by varying the density of the insulating core 826, the thickness of the face sheets 812 and 814 and the joining sides 816, 818, 820, and 822 is also controlled to maintain sufficient strength while minimizing the weight of the building panel. In addition, the properties of the building panel are controlled by the number and pattern of shear resistance connectors 830 on the shear resistance connector array 828. Accordingly, a building panel 810 of the present invention can be easily manufactured to have a preselected compressive strength, shear strength, tensile strength, flexural strength, weight, insulative value, and acoustical characteristics.

Figure 9:
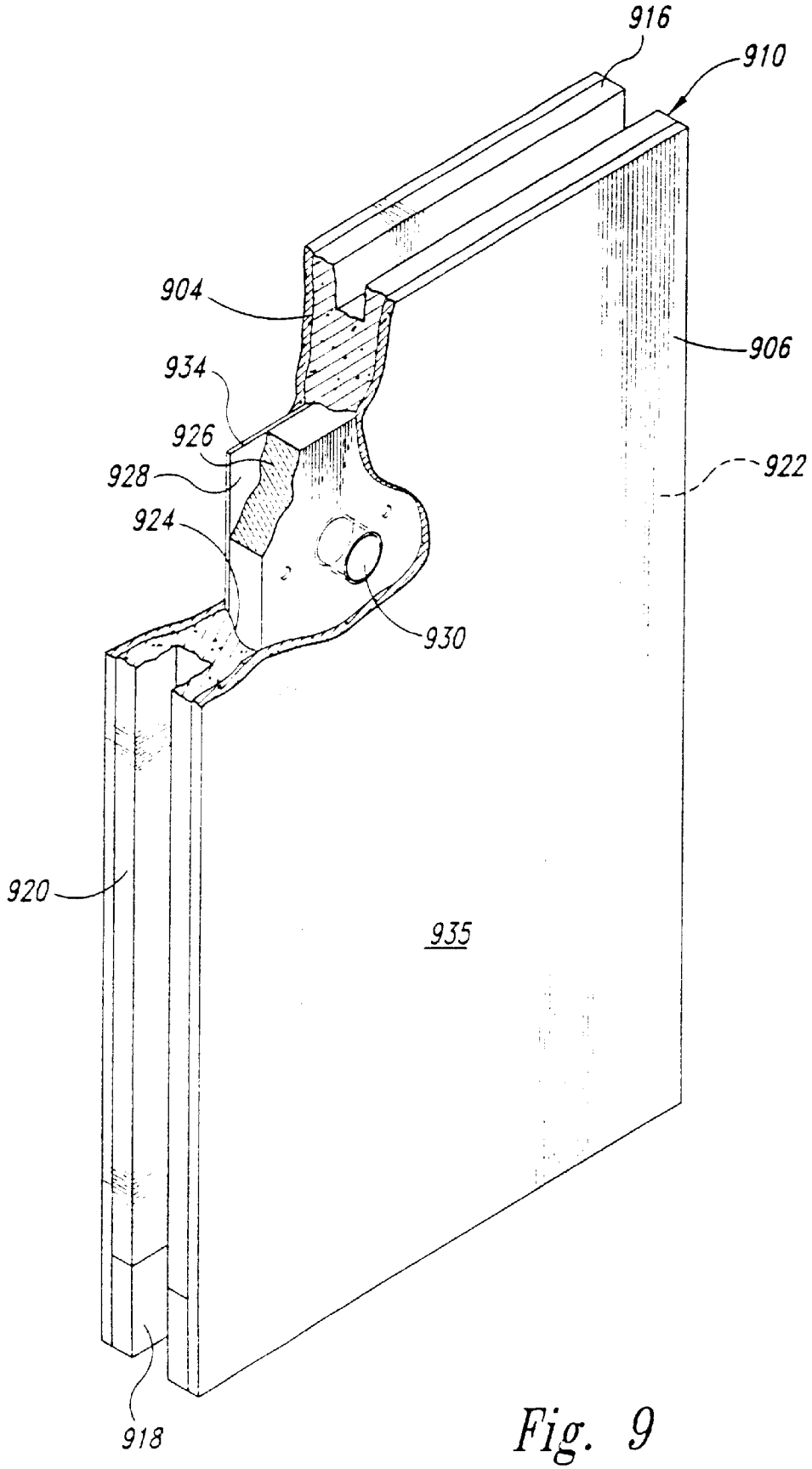
FIG. 9 is an isometric view of the building panel in accordance with an embodiment of the present invention, and a corner of the panel being illustrated partially cut away showing an insulating core and a shear resistance connector array within the building panel.
Figure 10:
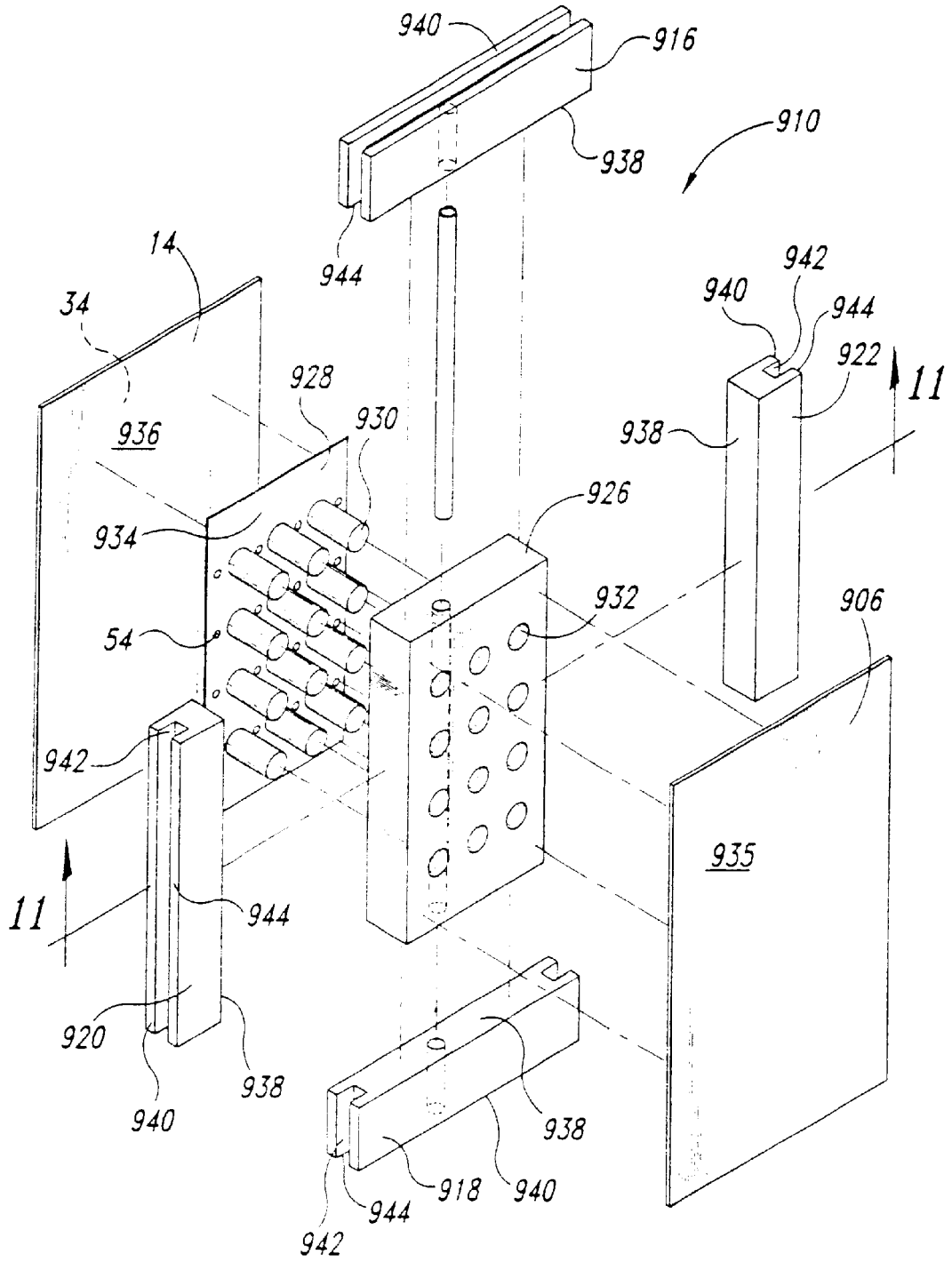
FIG. 10 is a reduced, schematic exploded view of the building panel illustrated in FIG. 8.

As best seen in FIGS. 9 and 10, the building panel 810 of a first embodiment includes a front face sheet 906 that defines a forward side of the panel and a back face sheet 904 opposite the front face sheet and spaced apart therefrom to define a back side of the panel. The front and back face sheets 906 and 904 are separated by a top joining side 916 and a bottom joining side 918 that are intermediate and at opposite ends of the face sheets. A left joining side 920 and a right joining side 922 are also intermediate the front and back face sheets 906 and 904 and extend between the top and bottom joining sides 916 and 918 at opposite edges of the face sheets. Accordingly, the front and back face sheets 906 and 904 and the joining sides 916, 918, 920, and 922 are interconnected to form a six-sided box-like structure having an interior chamber 924 therein.

A shear resistance connector array 928 having a sheet-like web 934 and shear resistance connectors 930 projecting from the web is positioned in the interior chamber 924. The web 934 is adjacent to the back face sheet 904 and the shear resistance connectors 930 project toward the back face sheet 904. An insulating core 926 is positioned in the interior chamber 924 and in engagement with the shear resistance connector array 928. The insulating core 926 has a plurality of throughholes 932 therein, and the shear resistance connectors 930 extend from the web 934, into the throughholes, and connect to the front face sheet 906.

The shear resistance connector array 928 is rigidly connected to the insulating core 926, the front face sheet 906, and the back face sheet 904 so as to provide increased shear force resistance strength and load bearing strength of the building panel 910. The shear resistance connector array 928 keeps the front and back face sheets 906 and 904 flat and very stiff such that, when the building panel 910 defines a portion of a building and wind loads, seismic loads, or other loads are exerted on the building, the face sheets distribute the loads over the entire building panel 910 and avoid concentrated point loads on the panel. Accordingly, the front and back face sheets 906 and 904, the joining sides 916, 918, 920, and 922, the shear resistance connector array 928, and the insulating core 926 are interconnected to provide a load-bearing, insulating building panel that greatly increases the shear force resistance strength and thermal efficiency of a panelized building structure constructed from the panels.

As best seen in FIGS. 9 and 10, the front and back face sheets 906 and 904 are stress-skin members each having an exterior surface 935 that faces away from the opposing face sheet and an interior surface 936 that communicates with the interior chamber 924. In the preferred embodiment of the invention, the front and back face sheets 906 and 904 are composite stress-skin sheets constructed of multiple layers of lightweight magnesium oxide-based mineral compound. The multiple layers are smoothly blended together and cured so as to prevent definitive layer intersection lines between adjacent layers. The front and back face sheets 906 and 904 each have three or more layers of the magnesium oxide-based mineral compound, and each layer includes a selected additive to provide the respective layer with predetermined characteristics. As an example, the innermost layer includes an additive having improved fire-resistance and the outermost layer includes an additive having improved bonding characteristics.

Figure 11:
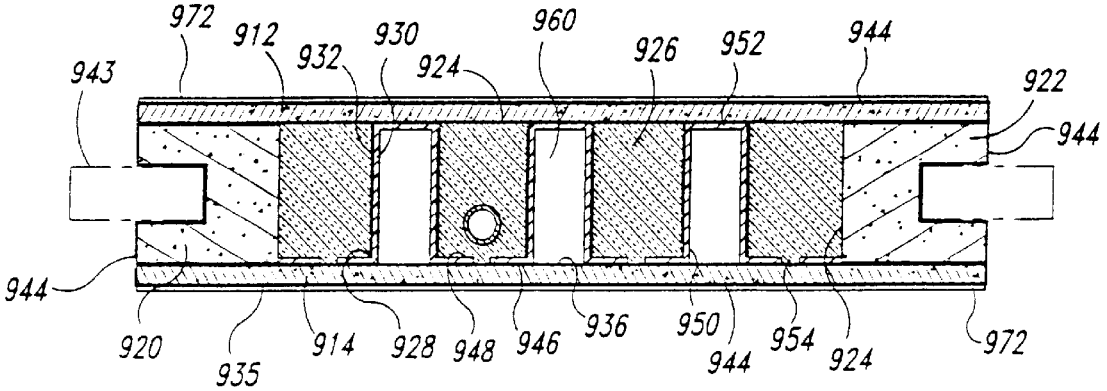
FIG. 11 is an enlarged cross-sectional view taken substantially along line 11—11 of FIG. 10 showing the shear resistance connector array in the interior area of the building panel.

In one embodiment, the front and back face sheets 906 and 904 are impregnated with a polymer to provide a smooth, bondable outer surface 935. A selected covering material 972, as best seen in FIG. 11, is attached to one or both of the front and back face sheets 906 and 904 and bonded to the bondable outer surface 935 to provide an aesthetically pleasing cover on the building panel 910. Examples of the covering materials include vinyl, paint, wallpaper, laminate coverings or the like.

In another alternate embodiment, the front and back face sheets 906 and 904 are constructed of a cured slurry mix of a lightweight mineral compound, such as a cement composition. The cement composition is created from cellular cement and a sufficient amount of high silica material to substantially improve the thermal and acoustical insulating and fire-resistant properties of the composition while not detracting materially from its strength. The cement composition includes a plurality of fluid pockets having substantially the same size and shape, wherein the fluid in the pockets is less dense than the cement used in the composition. The fluid pockets reduce the overall density and weight of the cement composition, and the insulating and fire-resistant properties of the cement composition are enhanced. Other compounds that could be used to form the front and back face sheets 906 and 904 include, for example, aerated cement-based compounds, magnesium-based compounds, non-cement base compounds. or other suitable material that demonstrates a high strength-to-weight ratio.

The front and back face sheets 906 and 904 of the first illustrative embodiment have a density in the range of 20 to 150 lbs. per cubic foot, and a minimum insulative value of 0.5 R per inch. Although components of the first embodiment are within the density range and above the minimum insulation value, the density or insulative values can deviate from the preferred values without departing from the spirit and scope of this invention. The preferred composite cellular concrete material is also flame-resistant and is impervious to very high heat, e.g., in excess of 2000 F. Thus, the building panel 910 is fire-resistant, lightweight, and has a high strength-to-weight ratio.

As best seen in FIG. 10, each of the top joining side 916, bottom joining side 918, left joining side 920, and right joining side 922 are elongated members sandwiched between the front and back face sheets 906 and 904. The joining sides 916, 918, 920, and 922 are adhered with a conventional adhesive, such as Dalbert epoxy or the like, to the interior surface 936 of the front and back face sheets 906 and 904 about the perimeter of the face sheets, such that the joining sides define edge portions of the building panel 910. Substantial strength is maintained in the building panel 910, because the front and back face sheets 906 and 904 span between the joining sides 916, 918, 920, and 922 and diaphragmatically brace the building panel. The increased strength of the building panel 910 from the diaphragmatic bracing allows the joining sides 916, 918, 920, and 922 and the face sheets 906 and 904 to be made from the lightweight material while providing a structurally sound building panel.

In the illustrated embodiment, the top, bottom, left, and right joining sides 916, 918, 920, and 922 are molded members constructed of the magnesium oxide-based mineral compound. The joining sides 916, 918, 920, and 922 each have an inner side portion 938 and an opposing outer side portion 940. Each inner side portion 938 faces toward the interior chamber 924 and defines a side of the interior chamber. Each outer side portion 940 faces outwardly away from the interior chamber and is substantially flush with edges of the front and back face sheets 906 and 904. The outer side portion 940 of each joining sides 916, 918, 920, and 922 includes a groove 942 that extends along the length of a respective joining side and connects with grooves of the adjacent joining sides. Accordingly, a substantially continuous groove extends around the perimeter of the building panel 910. In the illustrated embodiment, the groove 942 removably receives a tongue or spline 943 therein, shown in phantom lines in FIG. 10, that interconnects two adjacent building panels, for example, during construction of a building or the like.

As best seen in FIGS. 10 and 11, the front and back face sheets 906 and 904, the top and bottom joining sides 916 and 918 (FIG. 10) and the left and right joining sides 920 and 922 include an integral liner 944 made of, as an example, a thin magnesium-based film that reacts exothermically with the magnesium oxide-based slurry material during manufacturing of the face sheets and joining sides. The exothermic reaction is such that the liner 944 securely and rigidly bonds to the outer surface of the respective face sheet 906 or 904 or joining side 916 (FIG. 10), 918 (FIG. 10), 920 and 922. The liner 944 sandwiches the magnesium oxide-based slurry mix therebetween to significantly increase the strength of the front and back face sheets 906 and 904 and the joining sides 916 (FIG. 10), 918 (FIG. 10), 920, and 922 without significantly increasing the weight of the panel.

In an alternate embodiment, a magnesium oxide-based covering material is sprayed onto the exterior surface 935 of the face sheets 906 and 904. The magnesium oxide-based covering reacts exothermically with the magnesium-based film on the face sheets and securely adheres to the face sheets to provide the selected desired exterior panel covering.

As best seen in FIGS. 9 and 10, the web 934 of the shear resistance connector array 928 in the first embodiment is a generally planar, rectangular-shaped member, and the shear resistance connectors 930 project substantially perpendicularly away from the web. The web 934 has an outer surface 946 that is fixedly connected to the interior surface 936 of the back face sheet 904. An inner surface 948 of the web 934 faces away from the back face sheet 904 toward the front face sheet 906 and is connected to the insulating core 926. Each of the shear resistance connectors 930 is integrally attached at one end to the inner surface 948 of the web 934 and terminates at a free end 952 away from the web. Alternatively, this end can be attached to the other side. The shear resistance connectors 930 are disposed on the web 934 in a selected pattern relative to the front and back face sheets 906 and 904, such as the illustrated pattern of four rows of three shear resistance connectors.

In the first illustrative embodiment, the shear resistance connector array 928 is a unitary sheet of plastic material vacuum formed over a mold so as to define the web 934 and the shear resistance or connectors 930 projecting from the web. The plastic material has a density that is less than the front and back face sheets 906 and 904 and the top, bottom, left, and right joining sides 916, 918, 920, and 922. Accordingly, the shear resistance connector array 928 has a density that is less than the face sheets and joining sides. The illustrated shear resistance connectors 930 are hollow, cylindrical members having an open end 950 adjacent to the web 934 and a closed, free end 952 spaced apart from the web. The web 934 is rigidly connected to the inside surface 936 of the back face sheet 904, the shear resistance connectors 930 project through the plurality of throughholes 932 in the insulating core 926. The closed free ends 952 of the shear resistance connectors 930 are rigidly connected to the interior surface 936 of the front face sheet 906. Although the shear resistant connectors are illustrated in FIG. 10 as being cylindrical members, the shear resistance connectors of alternate embodiments have different geometrical cross-sectional shapes, such as rectangular, square, or polygonal.

The web 934 and the shear resistance connectors 930 effectively keep the front and back face sheets 906 and 904 flat and very stiff so the face sheets distribute wind loads, seismic loads, or other loads over the entire building panel and provide directional stability of the panel with respect to the anticipated directions of loads. The flat, stiff stress-skin face sheets 906 and 904 also allow the building panel 810 to be made with a deeper or thinner section while utilizing lightweight and insulative material, such as polyisocyanurate or other modified, closed-cell polyurethane foam, as the insulating core 926 without diminishing the load-bearing capabilities of the building panel.

In one embodiment illustrated in FIG. 10, the web 934 of the shear connecting array 928 is adhered directly to the interior surface 936 of the back face sheet 904, and the closed free ends 952 of the shear resistance connectors 930 are adhered directly to the interior surface 936 of the front face sheet 906. The shear resistance connectors 930 extend through the throughholes 932 in the insulating core 926 and are adhered to the insulating core at the sidewalls that define the throughholes. Accordingly, the shear resistance connectors 930 are rigidly fixed from movement relative to the front and back face sheets 906 and 904 and the insulating core 926.

In another embodiment (not shown), the web 934 of the first illustrative embodiment has a plurality of apertures 954 spaced about the web between the shear resistance connectors 930. A thin layer 956 of cured polyisocyanurate insulating core material between the outer surface 946 of the web 934 and the interior surface 936 of the back face sheet 904 and through the apertures 954. The thin layer 956 of polyisocyanurate fixedly adheres the web 934 to the interior surface 936 of the back face sheet 904. The thin layer 956 of polyisocyanurate extends through the apertures 954 in the web 934 and is integrally connected to the insulating core 926. Accordingly, the web 934 is fully encased in the cured polyisocyanurate insulation material.

The polyisocyanurate also extends into and fills the hollow inside area 960 of the shear resistance connectors 930. The polyisocyanurate in the shear resistance connectors 930 extends out the shear resistance connector's open end 950 and is integrally connected to the thin layer 956 of polyisocyanurate between the web 934 and the back face sheet 904. Accordingly, the throughholes 932, are completely filled with the shear resistance connectors 930 and the insulative material within the shear resistance connectors (not shown). As a result, the building panel 910 has a very high compression strength and shear strength.

In the illustrated embodiment of FIGS. 8–11, each building panel 910 is approximately five feet wide, eight feet tall, and six inches thick. The front and back face sheets 906 and 904 are stress-skin sheets having a thickness of approximately ¼ inch to 1 inch, and the joining sides 916, 918, 920, and 922 are approximately three inches deep. When a plurality of building panels 910 are joined together to form, for example, a panelized wall, the interconnected left and right joining sides 920 and 922 form a six inch by six inch laminated post every five feet of linear wall surface, and the interconnected top and bottom joining sides 916 and 918 form a six inch by six inch laminated beam at every eight vertical feet of wall surface. Accordingly, as the building panels 910 are stacked to accommodate the multistory building structure, the laminated structural support member is formed naturally at each junction between adjacent building panels. The above dimensions are provided for illustrative purposes, and a building panel 910 in accordance with the present invention can have different dimensions and ranges of dimensions without departing from the spirit and scope of the invention.

The building panel 910 of the first illustrated embodiment is constructed by adhering the top, bottom, left, and right joining sides 916, 918, 920, and 922 to the interior surface 936 of the back face sheet 904 about the perimeter of the interior surface such that the joining sides and the back face sheet form a five-sided box structure with an open front side that exposes the interior chamber 924. The five-sided box structure is supported so the open front side faces up. Liquid polyisocyanurate foam is pumped into the interior chamber 924 to form the thin layer 956 of foam that covers the interior surface 936 of the back face sheet 904. As soon as the liquid foam is pumped into the interior chamber 924, closed-cell gas pockets are generated within the foam, and the foam expands in volume.

After the first layer of foam is added, the shear resistance connector array 928 is placed into the interior chamber 924 and the web 934 is set onto the thin layer 956 of foam. The web 934 has approximately the same length and width dimensions as the interior chamber 924 so the web is immediately adjacent to the top, bottom, left, and right joining sides 916, 918, 920, and 922. As a result, all of the shear resistance connectors 930 are placed in a preselected position relative to the joining sides 916, 918, 920, and 922 and proper positioning of the shear resistance connectors within the interior chamber 924 is automatic and takes seconds.

After the shear resistance connector array 928 is initially placed into the interior chamber 924, the shear resistance connector array is pressed toward the back face sheet 904 to a selected position. Some of the expanding foam is displaced as the shear resistance connector array 928 is pressed into place, and the foam extends upwardly through the apertures 954 in the web 934. The foam also expands upwardly through the open end 950 of the shear resistance connectors 930 into the inner area 960. The volume of the displaced and expanding foam is sufficient to fill the inner areas 960 of the shear resistance connectors 930, so as to provide solid cores in the shear resistance connectors after the foam is cured and hardened.

After the shear resistance connector array 928 is in the selected position within the interior chamber 924, additional liquid polyisocyanurate foam is pumped into the interior chamber. The polyisocyanurate foam expands and fills the interior chamber 924 as the gas pockets are formed, and the front face sheet 906 is fixedly secured to the joining sides 916, 918, 920, and 922 to cover the interior chamber 924. The amount of foam pumped into the interior chamber 924 is such that the foam would expand and overflow from the interior chamber if allowed to freely and fully expand. However, the front face sheet 906 is secured in place before the foam fully expands, and the front face sheet blocks the foam from expanding beyond the volume of the interior chamber 924. The foam is a self-bonding foam that bonds to the face sheets and the shear resistance connector array 926.

When the front face sheet 906 is secured in position, the interior surface 936 of the front face sheet is adjacent to the closed free ends 952 of the shear resistance connectors 930 and a thin layer of the polyisocyanurate foam extends between the closed free ends and the front face sheet. The polyisocyanurate foam in the interior chamber 924 completely encases the shear resistance connector array 928 and the foam then cures and hardens to define a strong, lightweight insulative core 900.

An alternate embodiment (not shown) includes a shear resistance connector array 928 having a web 934 that is a substantially rectangular sheet of plastic material, and the sheer connectors 970 are solid members fixedly adhered to the inner surface 948 of the web in a predetermined pattern during an array manufacturing process. The solid shear resistance connectors 970 and the web 934 are moved as a unit and placed into the interior chamber 924 of the building panel 910 during assembly of the building panel. In yet another embodiment of the invention, the shear resistance connector array 928 is placed into the interior chamber 924 and the web 934 is adhered directly to the interior surface 936 of the back face sheet 904. Thereafter, the insulating core 926 is placed in the interior chamber 924 and the insulating core surrounds and encases the shear resistance connectors 930. The front face sheet 906 is then adhered to the joining sides 916, 918, 920, and 922 to cover the interior area 924 and to close out the building panel 910.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A structural building system adapted to have a selected load applied thereto comprising:

a plurality of interconnected asymmetrical structural building panels, each panel having a front side portion, a back side portion, an insulative core between the front and back side portions, joinery portions integral to a respective one of the front and back side portions, and a shear resistance connector in one of the front side portion and back side portion and extending into the insulative core, each structural building panel being fixably connected to an adjacent structural building panel, and each panel is positionable to have the selected load applied to a side portion of the building panel opposite the shear resistance connector, each building panel having a strength, a weight, and a strength-to-weight ratio equal to or greater than 33 to 1; and a face sheet attached to the one of the front and back side portions with the shear resistance connector therein of at least one of the structural building panels.

2. A structural building system adapted to have a selected load applied thereto comprising:

a plurality of interconnected asymmetrical structural building panels, each panel having a front side portion, a back side portion, an insulative core between the front and back side portions, joinery portions integral to a respective one of the front and back side portions, and a shear resistance connector in one of the front side portion and back side portion and extending into the insulative core, each structural building panel being fixably connected to an adjacent structural building panel, and each panel is positionable to have the selected load applied to a side portion of the building panel opposite the shear resistance connector, each building panel having a strength, a weight, and a strength-to-weight ratio equal to or greater than 33 to 1; and a face sheet connected to the adjacent front or back side portions of adjacent structural building panels.

3. A structural building system adapted to have a selected load applied thereto comprising:

a plurality of interconnected asymmetrical structural building panels, each panel having a front side portion, a back side portion, an insulative core between the front and back side portions, joinery portions integral to a respective one of the front and back side portions, and a shear resistance connector in one of the front side portion and back side portion and extending into the insulative core, each structural building panel being fixably connected to an adjacent structural building panel, and each panel is positionable to have the selected load applied to a side portion of the building panel opposite the shear resistance connector, each building panel having a strength, a weight, and a strength-to-weight ratio equal to or greater than 33 to 1; and a face sheet fixedly connected to at least two adjacent and connected structural building panels, the face sheet extending over the connector between the adjacent building panels.

* * * * *